US010457514B2

(12) United States Patent
Osgood et al.

(10) Patent No.: US 10,457,514 B2
(45) Date of Patent: Oct. 29, 2019

(54) SELF-CONTAINED TENSION CONTROL SYSTEM

(71) Applicant: The Montalvo Corporation, Gorham, ME (US)

(72) Inventors: Christopher Osgood, Woolwich, ME (US); Jonathan Hanson, Durham, ME (US)

(73) Assignee: The Montalvo Corporation, Gorham, ME (US)

( * ) Notice: Subject to any disclaimer, the term of this patent is extended or adjusted under 35 U.S.C. 154(b) by 114 days.

(21) Appl. No.: 15/507,896

(22) PCT Filed: Aug. 31, 2015

(86) PCT No.: PCT/US2015/047668

§ 371 (c)(1),
(2) Date: Mar. 1, 2017

(87) PCT Pub. No.: WO2016/036640

PCT Pub. Date: Mar. 10, 2016

(65) Prior Publication Data

US 2017/0297852 A1 Oct. 19, 2017

Related U.S. Application Data

(60) Provisional application No. 62/044,547, filed on Sep. 2, 2014.

(51) Int. Cl.
*B65H 23/14* (2006.01)
*B65H 23/06* (2006.01)
*B65H 23/10* (2006.01)

(52) U.S. Cl.
CPC ..... *B65H 23/14* (2013.01); *B65H 23/06* (2013.01); *B65H 23/10* (2013.01); *B65H 23/105* (2013.01);
(Continued)

(58) Field of Classification Search
CPC .. B65H 23/044; B65H 23/063; B65H 23/066; B65H 23/14; B65H 23/10; B65H 23/105;
(Continued)

(56) References Cited

U.S. PATENT DOCUMENTS 4,076,184 A 2/1978 Morgan
4,151,594 A 4/1979 Stern
(Continued)

FOREIGN PATENT DOCUMENTS

DE 112015004009 T5 5/2017
EP 2179852 A1 4/2010
(Continued)

OTHER PUBLICATIONS

"International Application Serial No. PCT/US2015/047668, International Preliminary Report on Patentability dated Mar. 16, 2017", 9 pgs.
(Continued)

*Primary Examiner* — Michael C McCullough
(74) *Attorney, Agent, or Firm* — Schwegman Lundberg & Woessner, P.A.

(57) ABSTRACT

Apparatus and methods are provided for a self-contained tension control system. An example self-contained tension control system can include a brake system configured to provide tension friction to a web, a tension transducer to provide tension information indicative of tension of the web, a controller configured to receive the tension information, to compare the tension information to set point information, and to provide a command signal to the brake system, and an enclosure configured to enclose the brake system, the tension transducer, and the controller, the enclosure including a first web opening and a second web opening configured to allow the web to enter the enclosure and to pass through the enclosure to equipment downstream of the self-contained tension control system.

24 Claims, 5 Drawing Sheets

(52) U.S. Cl.
CPC .. *B65H 2403/7255* (2013.01); *B65H 2403/92* (2013.01)

(58) Field of Classification Search
CPC ..... B65H 51/30; B65H 59/22; B65H 59/38; B65H 59/382; B65H 59/388; B65H 59/40; B65H 57/003; B65H 2301/522; B65H 2402/44; B65H 2402/441; B65H 2402/442; B65H 2402/443; B65H 2402/45
USPC ..... 226/195
See application file for complete search history.

(56) References Cited

U.S. PATENT DOCUMENTS 4,242,556 A * 12/1980 Ullmann ..... B23H 7/10 219/69.12
4,416,431 A * 11/1983 Singer ..... B65H 57/003 242/151
4,709,872 A 12/1987 Hammer et al.
5,234,177 A 8/1993 Maji et al.
5,476,122 A * 12/1995 Schuster ..... B65H 59/22 139/194
5,791,541 A 8/1998 Jitsuishi et al.
5,894,797 A 4/1999 Brennan et al.
6,405,964 B1 * 6/2002 Ruskens ..... B65H 54/70 242/474.2

FOREIGN PATENT DOCUMENTS

GB 704672 A 10/1950
WO WO-2016036640 A1 3/2016

OTHER PUBLICATIONS

"International Application Serial No. PCT/US2015/047668, International Search Report dated Jan. 19, 2016", 2 pgs.
"International Application Serial No. PCT/US2015/047668, Written Opinion dated Jan. 19, 2016", 7 pgs.

* cited by examiner

SELF-CONTAINED TENSION CONTROL SYSTEM

PRIORITY AND RELATED APPLICATIONS

This application is a U.S. National State Filing under 35 U.S.C. 371 from International Application No. PCT/US2015/047668, filed Aug. 31, 2015, which application claims the benefit of priority to Osgood et al., U.S. Provisional Patent Application No. 62/044,547, filed on Sep. 2, 2014, and entitled, "SELF-CONTAINED TENSION CONTROL SYSTEM," which applications are hereby incorporated by reference herein in their entirety.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
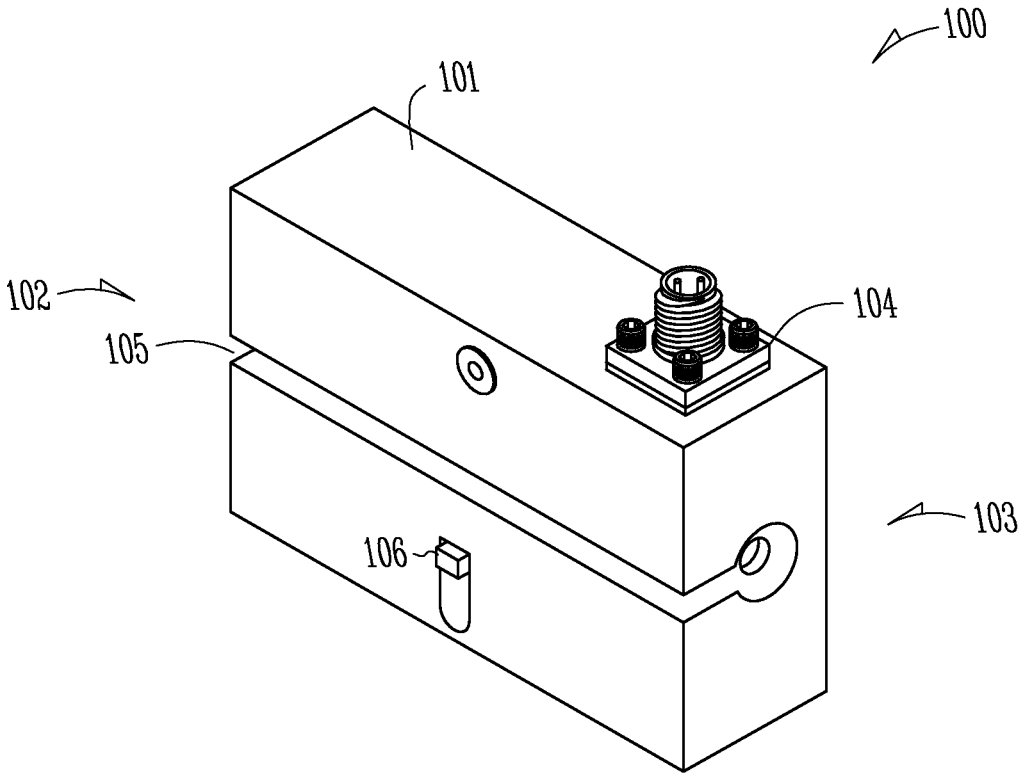
FIG. 1 illustrates generally a self-contained web tension control system.

The present inventors have recognized a self-contained tension control system for web applications including, but not limited to, fiber or ribbon type ultra-narrow web applications. FIG. 1 illustrates generally a self-contained tension control system 100, such as for web tensioning. In certain examples, the system includes a housing 101, or enclosure, having a web input opening (hidden) 102, a web output opening 103, one or more connectors 104, an optional load slot 105 and an optional manual load slide operator 106. During web processing operations, web (not shown) can enter the housing 101 through the web input opening 102 and exit the housing 101 through the web output opening 103. The one or more connectors 104 can provide electrical and/or pneumatic power to the self-contained tension control system 100. In certain examples, the optional load slot 105 can provide easy access to thread the web through the interior web path of the self-contained tension control system 100. In some examples, the interior web path can deviate significantly from the path of the optional load slot 105. In such examples, an optional load mechanism including the manual load slide operator 106 can allow a loading web path to conform to the load slot 105 when the manual load slide operator 106 is in a first load state. After loading the web through the load slot 105, the manual load slide operator 106 can be placed in a second run state that changes the web path for web movement and web tension control.

As will be discussed below, inside the housing 101, the self-contained tension control system 100 can include control electronics, one or more tension actuators, a tension transducer, and guide devices to guide the web through the housing. In certain examples, the guide devices can be used primarily for initially loading or passing the web through the housing 101 where the housing 101 does not include a load slot. In some examples, the guide devices can include stationary guides to direct an end of the web through the housing. Such stationary guides can be particularly useful where the web path through the housing is not straight or where the web enters the housing 101 at a first angle and then exits the housing at a different angle. In some examples, stationary guides can be used to allow a web to exit the housing 101 at a significantly different angle than the web enters the housing 101, thus allowing the trajectory of the web path to be changed at the self-contained tension control system 100. In certain examples, the guide devices can include idlers such as idler rolls, to guide the web through the housing during normal operations. In some examples, the idler rolls include a rotatable member that can rotate as the web moves. In some examples, the idler do not include a rotatable member but do provide a smooth surface over which the web can pass.

Figure 2A:
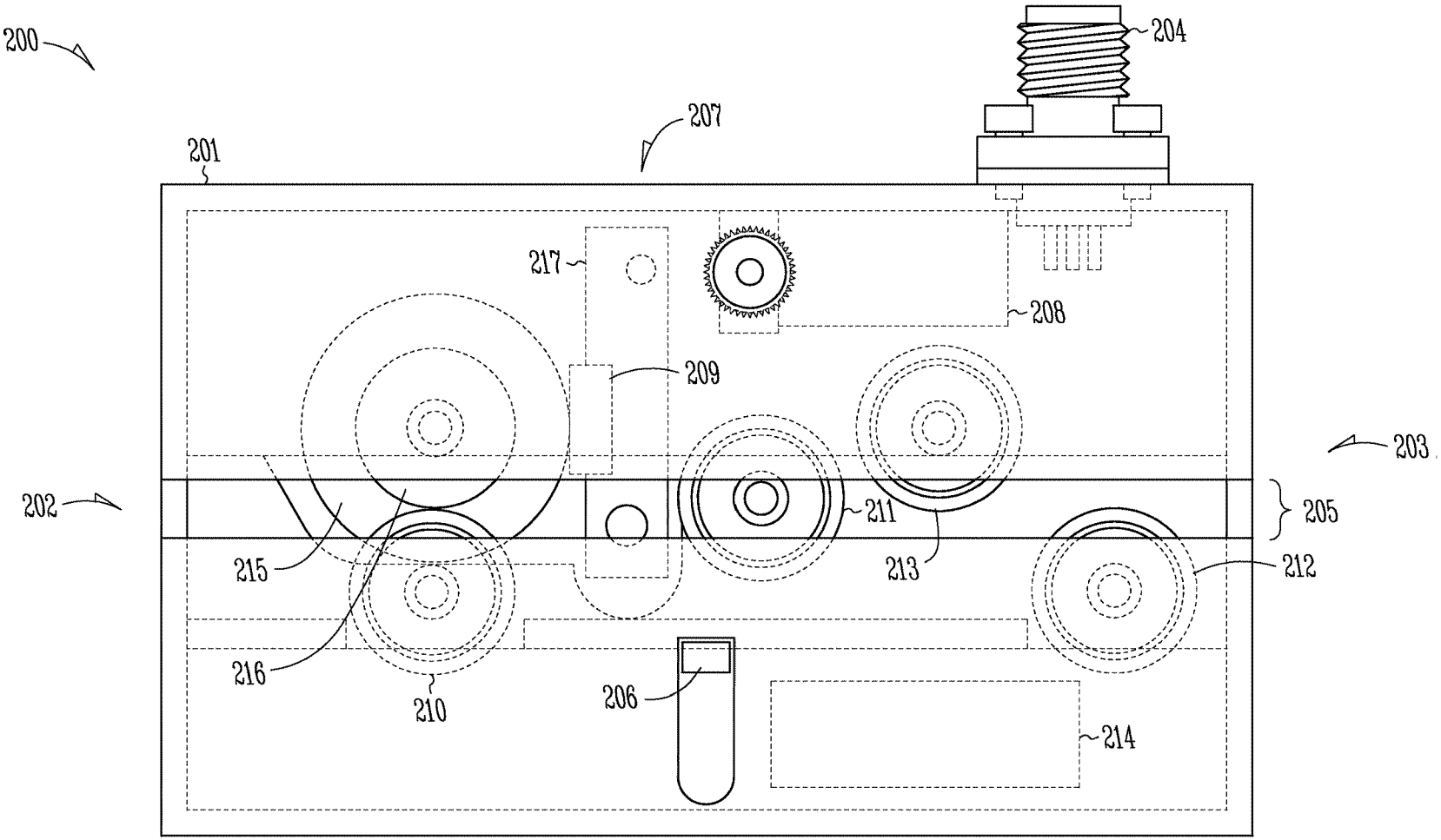
FIG. 2A illustrates an interior view of an example self-contained tension control system.

FIG. 2A illustrates an interior view of an example self-contained tension control system 200. In certain examples, the self-contained tension control system 200 can include an enclosure 201 with one or more connectors 204 and openings 202, 203 to allow web to be loaded and to pass through the enclosure 201. The self-contained tension control system 200 can further include a load mechanism including a manual load slide operator 206, idlers 210, 211, 212, tension brake system 207, a tension transducer 213, and a controller 214.

In certain examples, the tension brake system 207 can include a brake actuator 208, a brake pad 209, and a brake disc 215. The illustrated example includes an electrical brake actuator 208 and lever 217 that when activated can rotate the brake pad 209 against the brake disc 215 to create mechanical or braking friction for developing web tension. The web tension can be developed at the web nip point between a brake roller 216 coupled to the brake disc 215 and a nip roller 210. In certain examples, the thrust of the brake actuator 208 can be controlled by the controller 214 to modulate the web tension. The illustrated example shows only one brake disc 215. In some examples, the tension brake system 207 can include an additional brake disc 215 to develop more web tension. In some examples, portions of the brake disc 215 can be exposed and can form part of the enclosure 201. Including an exposed brake disc can enable the brake disc 215 to dissipate heat better and, in turn, extend the tension range of the self-contained tension control system 200 without increasing the size of the self-contained tension control system 200.

As discussed above, the self-contained tension control system 200 can include several idlers 210, 211, 212. In the illustrated example of FIG. 2A, a first idler can be the nip roller 210 with a rotating member and can be used to nip the web material against the brake roller 216. In some examples, nip rollers of this type can include a friction coating to reduce web slippage between the brake roller 216 and the nip roller 210 such that tension can be more precisely controlled. A second idler can include a tension transducer idler 213 to measure web tension. In certain examples, the tension transducer idler 213 can include a rotating member to reduce friction of the web path through the self-contained tension control system 200. The tension transducer idler 213 can sense tension asserted by the web on the idler and can provide an electrical signal including tension information to the controller 214 indicative of the sensed tension. Additional idlers such as a third idler 211 and a fourth idler 212 can direct the web around the tension idler 213 at a predetermined wrap angle. The fourth idler 212 can also direct the web through the web output opening 203 of the enclosure 201.

Figure 2B:
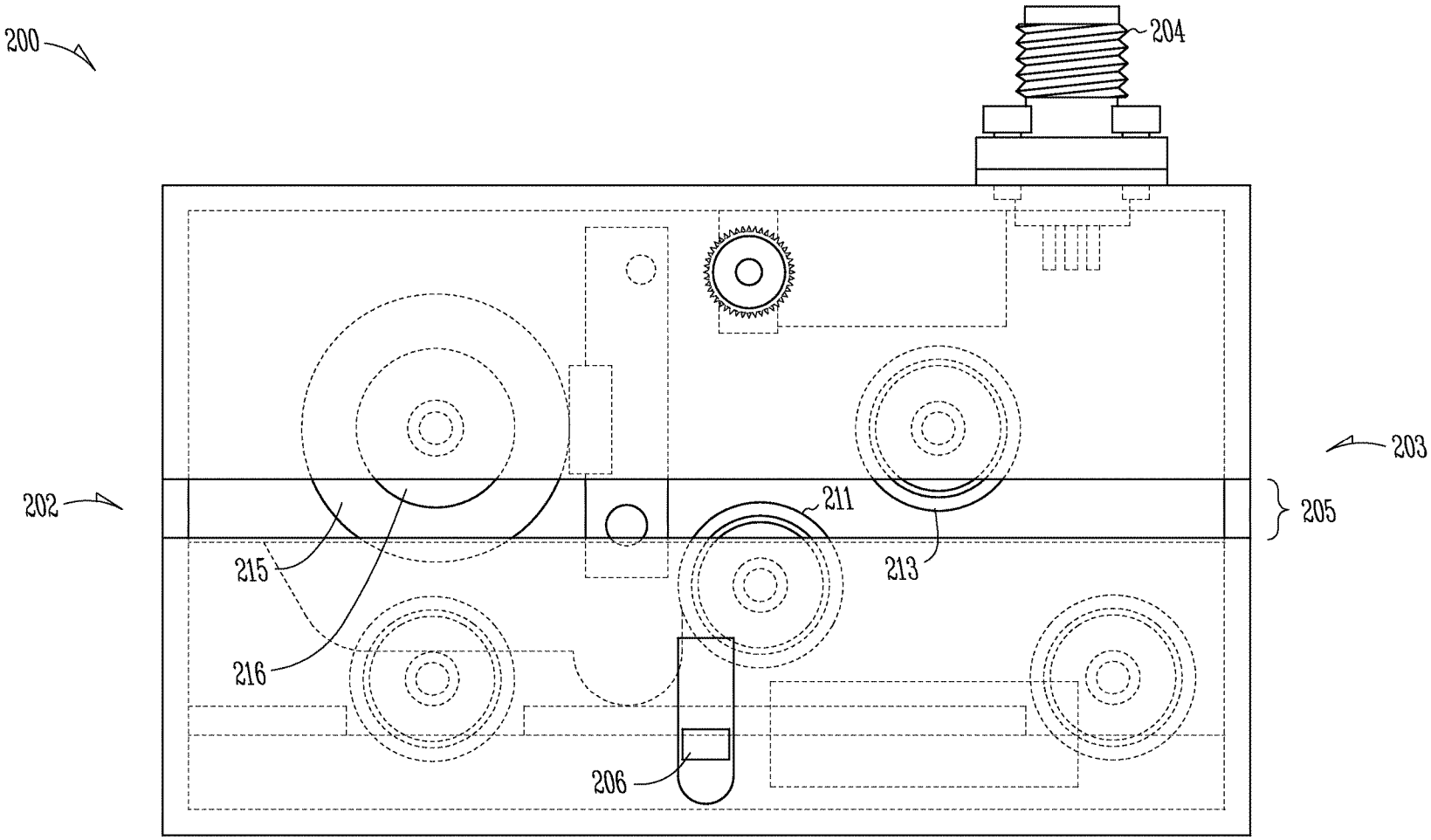
FIG. 2B illustrates generally the load mechanism of the example self-contained tension control system in a load state.

In certain examples, one or more of the internal components can be coupled to a load mechanism to allow initial loading of the web through the enclosure 201. The illustrated example includes an optional load slot 205 and the first, third and fourth idler 210, 211, 212 can be coupled to the load mechanism. FIG. 2A illustrates the load mechanism in a run state. FIG. 2B illustrates generally the load mechanism of the example self-contained tension control system 200 in a load state. Referring to FIG. 2B, note that the first nip roller 210 is retracted from the braking roller 216, and the third idler 211 and the fourth idler 212 are lowered from the web line defined by the load slot 205 such that the web can be loaded by passing a portion of the web through the load slot 205 and then placing the load mechanism in the run state. In addition, the load mechanism can allow an already loaded web to be released from the self-contained tension control system 100 including being released from the nip point formed by the nip roller 210 and the brake roller 216. In certain examples, the load mechanism can be manually operated via an external operator, such as an external manual load slide operator 206. In certain examples, a default position of the load mechanism can be the run position. In some examples, the load mechanism can include a spring return-type mechanism to maintain the load mechanism in a default position. In some example, the spring return-type mechanism can include a spring actuator. In some examples, the spring return-type mechanism can include a pneumatic actuator. In some examples, the load mechanism can be controlled by the controller 214. Controller actuation of the load mechanism can provide operational efficiency on some applications, such as where a large number of self-contained tension control systems are used. In such cases, groups or zones of self-contained tension control systems can be controlled together during the web loading process such that the operator does not have to individually actuate each load mechanism.

In certain examples, the controller 214 can receive power via the one or more connectors 204. The controller 214 can adjust the tension brake system 207 to provide a web tension according to a tension set point. In certain examples, the controller 214 can provide closed loop tension control to the set point by using the signal provided by the tension transducer 213. In certain examples the tension set point can be programmable. In some examples, an adjustment control such as a switch, potentiometer or some other user interface can be provided at the enclosure 201 to adjust the set point and provide tension set point information. In some examples, the controller 214 can be coupled to a communication network such as a wired network or a wireless network, and a central controller can monitor and adjust control parameters of the controller 214 using the communication network.

In certain applications, a self-contained tension control system 200 according to the present subject matter can provide better control efficiency especially in applications where multiple fiber or ribbon type webs are being processed together. In addition to the wiring, communication and closed loop control benefits offered by a wireless, self-contained tension control scheme, in certain examples, the enclosure 201 of the tension controller can be narrow and can allow the self-contained tension control systems to be stacked in a compact area compared to tension control systems that distribute one or more of the controller, tension brake system or tension transducer outside a common enclosure. Such stacking can save valuable plant space that may be able to be used for other productive activities.

In certain applications, multiple self-contained tension control systems can be stacked in racks to provide tension control for a multiple web process. In certain examples, the racks can provide power to the self-contained tension control systems. In some examples, the racks can provide control information to the controllers of the self-contained tension control systems. In some examples, the controller of each self-contained tension control system can include a transceiver for wirelessly exchanging control and status information with a supervisory processor. Such a configuration can provide a compact configuration of multiple tension controllers, individual tension system configuration and set points via the wireless communication, and efficient installation and replacement because many control connections are eliminated with the wireless communications.

Figure 3A:
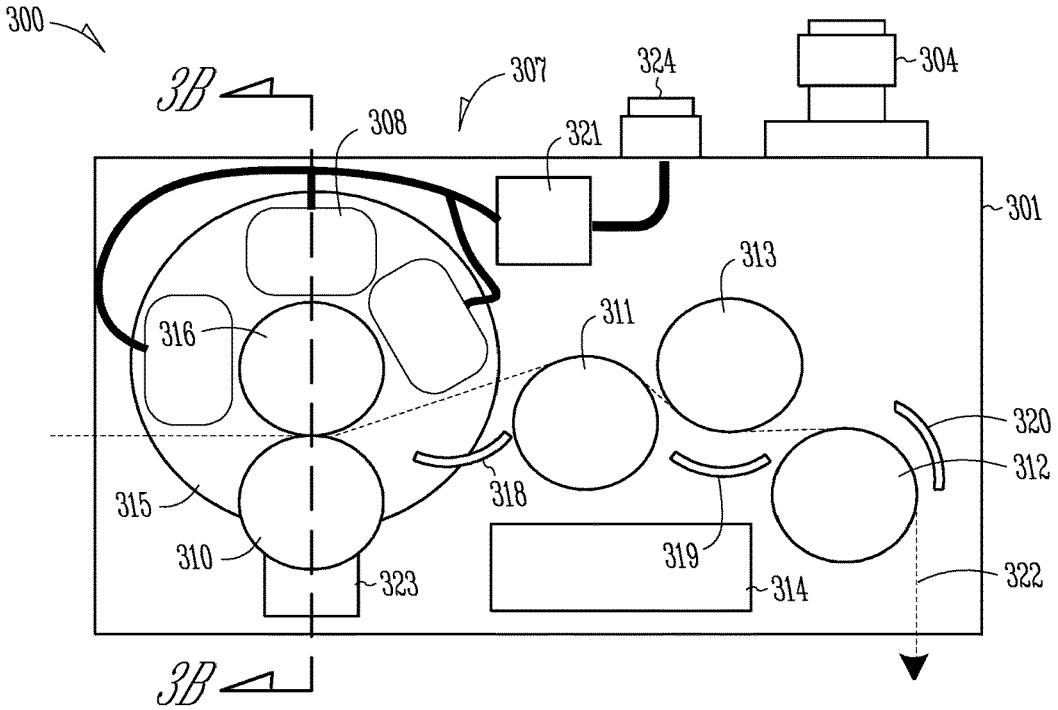
FIGS. 3A and 3B illustrate generally an example self-contained tension control system without a load slot and employing a disk-style brake.

FIG. 3A illustrates generally an example self-contained tension control system 300 without a load slot and employing a disk-style tension brake system 307. In certain examples, the self-contained tension control system 300 can include a housing 301 or enclosure, one or more connectors 304, 314, idlers 310, 311, 312, web guides 318, 319, 320, tension brake system 307, a tension transducer idler 313, and a controller 314.

Figure 3B:
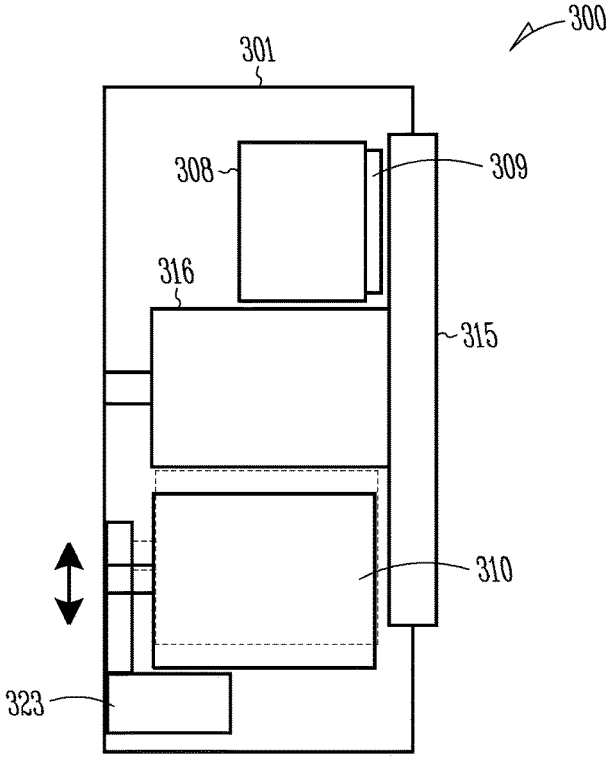

In certain examples, the tension brake system 307 can include a one or more brake actuators 308 each including a brake pad 309, and a brake disc 315. The illustrated example includes pneumatic brake actuators 308 that when activated can press the brake pad 309 against a first surface of the brake disc 315 to create braking friction for developing web tension. The web tension can be developed at the nip point between a brake roller 316 coupled to the brake disc 315 and a nip roller 310. In certain examples, the thrust of the brake actuator 308 can be controlled by the controller 314 to modulate the web tension. In the illustrated example, a proportional pneumatic valve 321 can be used to receive a command signal from the controller 314 and provide a proportional pneumatic pressure to each brake actuator 308. The illustrated example shows only one brake disc 315. In some examples, the brake roller 316 can be coupled to one or more additional brake discs to develop more web tension. In some examples, as shown in FIG. 3B, portions of the brake disc 315 can be exposed and can form part of the housing 301. Such arrangement of the exposed brake disc can enable the brake disc 315 to dissipate heat better and, in turn, extend the tension range of the self-contained tension control system 300 without increasing the size of the self-contained tension control system 300. In some examples, an exposed brake disc 315 can be mounted to each side of the brake roller 316.

As discussed above, the self-contained tension control system 300 can include several idlers 310, 311, 312, 313. In the illustrated example of FIGS. 3A and 3B, a first idler, the nip roller 310, can include a rotating member and can be used to nip the web material against the brake roller 316. In some examples, nip rollers of this type may include a friction coating to reduce web slippage between the brake roller 316 and the nip roller 310 such that tension can be more precisely controlled. A second idler can include a tension transducer idler 313 to measure web tension. In certain examples, the tension transducer idler 313 can include a rotating member to reduce friction of the web path through the self-contained tension control system 300. The tension transducer idler 313 can sense tension asserted by the web on the idler 313 and can provide an electrical signal to the controller 314 indicative of the sensed tension. Additional idlers, such as a third idler 311 and a fourth idler 312 can direct the web around the tension transducer idler 313 at a predetermined wrap angle. The fourth idler 312 can also direct the web through a web output opening of the housing 301 along the desired web path 322, even when a web output opening that allows the web to exit the housing 301 is at a different angle than when the web entered the housing 301.

In certain examples, the self-contained tension control system 300 can include one or more guides 318, 319, 320 especially where the housing 301 does not include a load slot. The guides 318, 319, 320 can be used to guide the initial loading of the web through the housing 301 by directing the loose end of the web to the next internal component of the self-contained tension control system 300.

In certain examples, one or more of the internal components can be coupled to a load mechanism 323 to allow initial loading of the web through the housing 301. The illustrated example includes the first idler or nip roller 310 coupled to an automated load mechanism 323 such that the load mechanism 323 can open a gap between the nip roller 310 and the brake roller 316 to accommodate initially threading the web through the self-contained tension control system 300. Although not shown in the illustrated examples, it is understood that guides can be coupled to a load mechanism to better position the guides for threading a loose end of the web material through the self-contained tension control system.

The examples described above use electric and pneumatic brake systems to develop web tension. It is understood that other braking method can be used without departing from the present subject matter including, but not limited to, magnetic particle brakes that can generate anti-rotational force using a controlled magnetic field.

Figure 4:
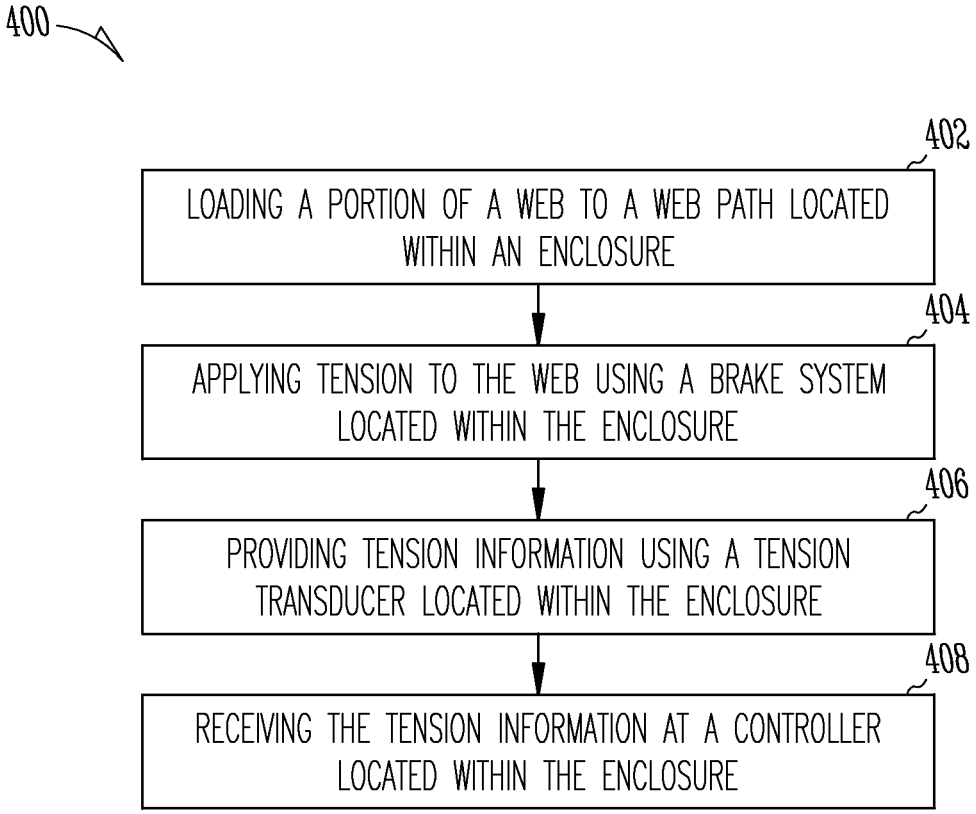
FIG. 4 illustrate generally a flowchart of an example method for providing web tension control.

FIG. 4 illustrate generally a flowchart of an example method for providing web tension control using a self-contained tension control system. At 402, a portion of web can be loaded to web path, the web path located within an enclosure or housing. At 404, tension can be applied to the web using a brake system located within the enclosure. At 406, a tension transducer located within the enclosure can provide tension information of the web. At 408, the tension information can be received at a controller housed within the enclosure. In certain examples, a command signal from the controller to the brake can be generated as a function of the tension information. In certain examples, a loading mechanism can be placed in a first state to open a slot in a side of the enclosure to assist with loading and unloading the web path within the enclosure. In certain examples, the loading mechanism can be placed in a second position to nip the web between a brake roller of the brake system and a nip roller. The brake roller and the nip roller can be housed within the enclosure.

The examples described above include a mechanical brake having a brake disk and some form of actuated brake pad. Other brake and tension mechanisms are possible for use in a self-contained tension control system without departing from the scope of the present subject matter. Other tension mechanisms can include braking motors, braking generators, clutches, magnetic brakes, dancers, or combinations thereof. In certain examples, a dancer can include a cantilever rotating arm to monitor or control the web tension, either with or without the brake nip portion. In some examples, the dancer can be pneumatically or electrically controlled. In some examples, a dancer arm can include either a rotary actuator or a linear actuator to apply web tension.

ADDITIONAL NOTES

In Example 1, a self-contained tension control system can include a brake system configured to provide tension friction to a web, a tension transducer to provide tension information indicative of tension of the web, a controller configured to receive the tension information, to compare the tension information to set point information, and to provide a command signal to the brake system, and an enclosure configured to enclose the brake system, the tension transducer, and the controller, the enclosure including a first web opening and a second web opening configured to allow the web to enter the enclosure and to pass through the enclosure to equipment downstream of the self-contained tension control system.

In Example 2, the self-contained tension control system of Example 1 optionally includes a nip roller configured to form a nip point with a component of the brake system, the nip point configured to capture the web and apply tension from the brake system to the web.

In Example 3, the brake system of any one or more of Examples 1-2 optionally includes a brake roller, the brake roller configured to interface with the nip roller to apply tension to the web.

In Example 4, the brake system of any one or more of Examples 1-3 optionally includes a magnetic particle brake coupled to the brake roller, the magnetic particle brake configured to impart an anti-rotation force to the brake roller to apply tension to the web.

In Example 5, the brake system of any one or more of Examples 1-4 optionally includes a brake disk coupled to the brake roller.

In Example 6, the brake system of any one or more of Examples 1-5 optionally includes a brake actuator configured to apply an adjustable amount of mechanical friction to the brake disk.

In Example 7, the brake actuator of any one or more of Examples 1-6 optionally includes a pneumatic actuator.

In Example 8, the brake system of any one or more of Examples 1-7 optionally includes an electrical actuator.

In Example 9, a first surface of the brake disk of any one or more of Examples 1-8 optionally can form a portion of an exterior surface of the enclosure.

In Example 10, the tension transducer of any one or more of Examples 1-9 optionally includes a tension transducer idler roll.

In Example 11, the self-contained tension control system of any one or more of Examples 1-10 optionally includes one or more idler rollers configured to guide the web about the tension transducer and through a nip point within the enclosure.

In Example 12, the one or more idler rollers of any one or more of Examples 1-11 optionally are configured to change a trajectory of the web, wherein an angle of entry of the web into the enclosure is different than an angle of exit from the enclosure.

In Example 13, the self-contained tension control system of any one or more of Examples 1-12 optionally includes one or more guides configured to guide a loose end of the web while loading the web through the enclosure.

In Example 14, the self-contained tension control system of any one or more of Examples 1-13 optionally includes a loading mechanism configured to at least release the web from a nip point formed by a nip roller in a first state and to capture the web in the nip point in a second state.

In Example 15, the loading mechanism of any one or more of Examples 1-14 optionally, in the first state, is configured to place one or more guides to direct an end of the web from the first web opening along a first web path and out the second web opening, and the loading mechanism of any one or more of Examples 1-14 optionally, in the second state, is configured to move the web to a desired web path within the enclosure, the desired web path extending from the first web opening, around the tension transducer and through the nip point.

In Example 16, the enclosure of any one or more of Examples 1-15 optionally includes a slot configured to allow a portion of the web to enter or exit the enclosure when the loading mechanism is in the first state, and the loading mechanism of any one or more of Examples 1-15 optionally, in the second state, is configured to capture the web in a desired web path within the enclosure, the desired web path extending from the first web opening, around the tension transducer and through the nip point.

In Example 17, the self-contained tension control system of any one or more of Examples 1-16 optionally includes a connector configured to allow electrical power to pass from outside the enclosure to the interior of the enclosure.

In Example 18, a method for operating a self-contained tension control system can include loading a portion of web from outside an enclosure along a web path located within the enclosure, applying tension on the web using a brake system located within the enclosure, providing tension information from a tension transducer housed within the enclosure, and receiving the tension information at a controller housed within the enclosure.

In Example 19, the loading of any one or more of Examples 1-18 optionally includes placing a loading mechanism in a first state to open a slot in a side of the enclosure; In Example 20, the loading of any one or more of Examples 1-19 optionally includes placing the loading mechanism in a second position to nip the web between a brake roller of the brake system and a nip roller, the brake roller and the nip roller housed within the enclosure.

In Example 21, the loading of any one or more of Examples 1-20 optionally includes placing a loading mechanism in a first state, and moving, via the loading mechanism, a plurality of web guides into a load position.

In Example 22, the placing a loading mechanism in a first state of any one or more of Examples 1-21 optionally includes moving, via the loading mechanism, one or more idler rollers to a load position.

In Example 23, the loading of any one or more of Examples 1-22 optionally includes threading an end of the web into the enclosure and guiding the end of the web through the enclosure to an exit of the enclosure using a plurality of web guides.

In Example 24, the loading of any one or more of Examples 1-23 optionally includes placing the loading mechanism in a second position to nip the web between a brake roller of the brake system and a nip roller, the brake roller and the nip roller housed within the enclosure.

In Example 25, the placing the loading mechanism in a second position of any one or more of Examples 1-24 optionally includes moving, via the loading mechanism, one or more idler rollers to wrap the web around the tension transducer.

In Example 26, the moving the one or more idler rollers of any one or more of Examples 1-25 optionally includes moving the tension transducer, via the loading mechanism, to wrap the web around the tension transducer.

A system or apparatus can include, or can optionally be combined with any portion or combination of any portions of any one or more of the examples or illustrations above to include, means for performing any one or more of the functions described above, or a machine-readable medium including instructions that, when performed by a machine, cause the machine to perform any one or more of the functions described above.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document, for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A self-contained tension control system comprising:

a brake system configured to provide tension friction to a web;

a tension transducer idler roll to provide tension information indicative of tension of the web;

a controller configured to receive the tension information, to compare the tension information to set point information, and to provide a command signal to the brake system; and an enclosure configured to enclose the brake system, the tension transducer idler roll, and the controller, the enclosure including a first web opening and a second web opening configured to allow the web to enter the enclosure and to pass through the enclosure to equipment downstream of the self-contained tension control system.

2. The self-contained tension control system of claim 1, including a nip roller configured to form a nip point with a component of the brake system, the nip point configured to capture the web and apply tension from the brake system to the web.

3. The self-contained tension control system of claim 2, wherein the brake system includes a brake roller, the brake roller configured to interface with the nip roller to apply tension to the web.

4. The self-contained tension control system of claim 2, wherein the brake system includes a magnetic particle brake coupled to the brake roller, the magnetic particle brake configured to impart an anti-rotation force to the brake roller to apply tension to the web.

5. The self-contained tension control system of claim 2, wherein the brake system includes a brake disk coupled to the brake roller.

6. The self-contained tension control system of claim 5, wherein the brake system includes a brake actuator configured to apply an adjustable amount of mechanical friction to the brake disk.

7. The self-contained tension control system of claim 6, wherein the brake actuator includes a pneumatic actuator.

8. The self-contained tension control system of claim 6, wherein the brake system includes an electrical actuator.

9. The self-contained tension control system of claim 6, wherein a first surface of the brake disk is configured to form a portion of an exterior surface of the enclosure.

10. The self-contained tension control system of claim 1, including one or more idler rollers configured to guide the web about the tension transducer idler roll and through a nip point within the enclosure.

11. The self-contained tension control system of claim 10, wherein the one or more idler rollers are configured to change a trajectory of the web, wherein an angle of entry of the web into the enclosure is different than an angle of exit from the enclosure.

12. The self-contained tension control system of claim 1, including one or more guides configured to guide a loose end of the web while loading the web through the enclosure.

13. The self-contained tension control system of claim 1, including a loading mechanism configured to at least release the web from a nip point formed by a nip roller in a first state and to capture the web in the nip point in a second state.

14. The self-contained tension control system of claim 13, wherein the loading mechanism, in the first state, is configured to place one or more guides to direct an end of the web from the first web opening along a first web path and out the second web opening; and wherein the loading mechanism, in the second state, is configured to move the web to a desired web path within the enclosure, the desired web path extending from the first web opening, around the tension transducer and through the nip point.

15. The self-contained tension control system of claim 13, wherein the enclosure includes a slot configured to allow a portion of the web to enter or exit the enclosure when the loading mechanism is in the first state; and wherein the loading mechanism, in the second state, is configured to capture the web in a desired web path within the enclosure, the desired web path extending from the first web opening, around the tension transducer and through the nip point.

16. The self-contained tension control system of claim 1, including a connector configured to provide for electrical power to pass from outside the enclosure to the interior of the enclosure.

17. A method for operating a self-contained tension control system, the method comprising:

loading a portion of web from outside an enclosure along a web path located within the enclosure;

applying tension on the web using a brake system located within the enclosure;

providing tension information from a tension transducer housed within the enclosure; and receiving the tension information at a controller housed within the enclosure; and wherein the loading includes placing a loading mechanism in a first state to open a slot in a side of the enclosure.

18. The method of claim 17, wherein the loading includes placing the loading mechanism in a second position to nip the web between a brake roller of the brake system and a nip roller, the brake roller and the nip roller housed within the enclosure.

19. The method of claim 17, wherein the loading includes moving, via the loading mechanism, a plurality of web guides into a load position.

20. The method of claim 17, wherein placing a loading mechanism in a first state includes moving, via the loading mechanism, one or more idler rollers to a load position.

21. The method of claim 17, wherein the loading includes threading an end of the web into the enclosure; and guiding the end of the web through the enclosure to an exit of the enclosure using a plurality of web guides.

22. The method of claim 21, wherein the loading includes placing the loading mechanism in a second position to nip the web between a brake roller of the brake system and a nip roller, the brake roller and the nip roller housed within the enclosure.

23. The method of claim 22, wherein placing the loading mechanism in a second position includes moving, via the loading mechanism, one or more idler rollers to wrap the web around the tension transducer.

24. The method of claim 23, wherein moving the one or more idler rollers includes moving the tension transducer, via the loading mechanism, to wrap the web around the tension transducer.

* * * * *